United States Patent [19]

Letner

[11] Patent Number: 4,777,675

[45] Date of Patent: Oct. 18, 1988

[54] DECONTAMINATION CHAMBER

[75] Inventor: Eugene Letner, Montgomery, Ala.

[73] Assignee: Benco Industries, Inc., Fort Deposit, Ala.

[21] Appl. No.: 918,705

[22] Filed: Oct. 14, 1986

[51] Int. Cl.[4] ..... A47K 3/23

[52] U.S. Cl. ..... 4/599; 4/612; 4/613; 4/603; 220/4 F

[58] Field of Search ..... 4/596, 597, 599, 600, 4/602, 603, 612–614, 620, 639; 52/79.5; 128/1 R, 1 B, 365, 371; 312/108, 257 SM, 257 A, 195, 101, 257 R; 220/DIG. 6, 4 F, 4 R, 67

[56] References Cited

U.S. PATENT DOCUMENTS

| | | | |
|---|---|---|---|
| 1,656,410 | 1/1928 | Baer et al. | 4/614 |
| 2,014,554 | 9/1935 | Bulthuis | 4/146 |
| 2,065,531 | 12/1936 | Kerr | 4/612 |
| 2,133,497 | 10/1938 | Winston | 189/2 |
| 2,567,506 | 9/1951 | Bowman | 4/147 |
| 3,149,347 | 9/1964 | Embroden | 4/614 |
| 3,462,771 | 8/1969 | Moretti | 4/613 |
| 3,940,806 | 3/1976 | Mastee | 4/146 |
| 4,152,789 | 5/1979 | Heath | 4/146 |
| 4,316,295 | 2/1982 | Whitney | 4/612 |
| 4,337,540 | 7/1982 | Lindeman | 4/612 |
| 4,348,777 | 9/1982 | Peterson | 4/596 |
| 4,471,501 | 9/1984 | Heymann | 4/599 |
| 4,539,721 | 9/1985 | Moore | 4/613 |
| 4,583,251 | 4/1986 | Karl et al. | 4/556 |

FOREIGN PATENT DOCUMENTS

| | | | |
|---|---|---|---|
| 1404713 | 11/1968 | Fed. Rep. of Germany . | |
| 2414601 | 10/1979 | France . | |
| 2424746 | 11/1979 | France . | |
| 359264 | 2/1962 | Switzerland | 4/612 |

*Primary Examiner*—Henry J. Recla
*Assistant Examiner*—Linda J. Sholl
*Attorney, Agent, or Firm*—Luedeka, Hodges & Neely

[57] ABSTRACT

A portable knockdown decontamination chamber is disclosed for use with a liquid decontaminant supply to apply a confined liquid decontaminant wash to a subject located in the chamber. A base of the chamber includes an upwardly opening channel formed generally around its periphery. A wall construction having arcuate corner panels and planar panels therebetween includes a lower edge shaped to fit in the channel so that the corner and planar panels are supported on the base with the lower edge residing in the channel. The base is formed by a subbase and a liner that have interacting rib structures, and the ribs are configured to provide a drainage network so that liquid accumulating in the channel is drained into a sump formed at one end of the base. A top has a downwardly opening groove extending generally around its periphery for receiving an upper edge of the wall construction so that the top can be placed in a supporting relationship on the wall construction. The configuration of the arcuate corner panels and the channel and groove in the base and top produces a coupling of the wall construction between the base and top that resists horizontal loading in all directions.

15 Claims, 8 Drawing Sheets

DECONTAMINATION CHAMBER

The present invention relates to decontamination chambers, portable shower stalls, and the like, and more particularly relates to a portable, knock-down decontamination chamber for use with liquid decontaminant supply to apply a confined liquid decontaminant wash to a subject located in the chamber.

Decontamination chambers in the form of portable shower stalls are used in the construction and manufacturing industries to remove potentially harmful substances from workers and tools. To prevent escape of the contaminants into the environment, the shower chamber must be designed to contain the washings so as to prevent overspill, and the washings are usually drained to a filter where the contaminants are removed before the effluent is released or recycled. Often, decontamination chambers are needed at remote locations such as at construction sites, and such chambers must be portable or movable from one location to another. To achieve portability the chambers should be light and easy to assemble and disassemble. However, such portable chambers must remain sturdy in construction and effective in removing and containing contaminants.

Known types of portable shower stalls or decontamination chambers suffer from a number of infirmities, especially their inherent lack of structural stability. Structural integrity is often sacrificed for a lightweight construction that is easy to disassemble and/or transport from site to site. The designs which appear to offer an acceptably strong construction are complicated by the addition of stabilizing features external to the function of the device, such as angle brackets, complicated joint networks, or other components that are "tacked on" to achieve the desired strength characteristics. This makes them difficult and costly to manufacture and assemble. These and other problems with portable shower stalls, decontamination chambers and the like have generally limited their practical usefulness in situations requiring portability, lightweight, strength, and simplicity of construction for on-site assembly.

Accordingly, a need exists for a decontamination chamber designed to address problems of structural stability that have plagued existing designs and which substantially prevents spillage of the washings to the outside. Additionally, the chamber should be easily assembled and disassembled in a very short time by only one or two people. To these ends, the chamber should be simple to manufacture, light in weight, and consist of only a few parts which can be assembled without the need of special tools or skills. Yet, the chamber should be of a strong construction so as to substantially eliminate the possibility of its collapse during use and provide adequate support for the subject or subjects located on the inside.

The present invention meets these needs through the provision of a portable, knockdown decontamination chamber which is constructed of a lightweight material and which comprises a minimal number of easily manufactured parts that can be quickly assembled and disassembled on site by one or two people with a few simple tools. The construction is strong to withstand horizontal and vertical loading and is configured to substantially prevent slippage of the washings to the outside.

In accordance with one form of the present invention, a portable, knockdown structure is disclosed for use with a liquid decontaminant applied to a subject located inside the structure. The structure includes a support surface for supporting the subject located inside the structure and a plurality of rounded corners formed on the support surface. Upwardly opening arcuate channel sections are formed along rounded corners of the support surface and upwardly opening linear channel sections are formed on the support surface extending between the arcuate channel sections to form a channel around the periphery of the support surface. Corner panels are provided, each of which has an arcuate panel section and at least one side panel section integrally formed with the arcuate panel section, the arcuate panel sections having lower edges configured to fit into the arcuate channel sections and the side panel sections having lower edges configured to fit into the linear channel sections, and the arcuate and side panel sections having upper edges. A top enclosure is provided for being supported on the upper edges of the arcuate and side panel sections and has arcuate grooves for receiving the upper edges of the arcuate panel sections. The top enclosure also includes linear grooves for receiving the upper edges of the side panel sections. The arcuate and linear grooves and the arcuate and linear channel sections form a coupling system for detachably coupling the corner panels between the support surface and the top enclosure. The corner panels interact with the top enclosure and support surface to resist horizontal loading from any horizontal direction.

In accordance with another aspect of the invention, the channel is defined between inner and outer upstanding, spaced-apart rims extending around the periphery of support surface. The inner and outer rims are spaced apart a distance of about, but greater than, the thickness of the arcuate and side panel sections of the corner panels and are configured so that liquid decontaminant entering the channel is confined between the inner and outer rims. Preferably, the inner and outer rims include opposed, substantially parallel, channel wall surfaces slanting away from the center of the surface. When the corner panels are oriented substantially perpendicular to the support surface with the lower edges of the arcuate and side panel sections located in the arcuate and linear channel sections, the channel wall surfaces of the inner and outer rims frictionally engage the lower edges to hold the corner panels in the channels.

In accordance with an additional aspect of the invention, a portable, knockdown structure is provided for use with a liquid decontaminant applied to a subject located inside the structure. The structure comprises a base having a support surface for supporting the subject located inside the structure and an upwardly opening channel extends generally around the periphery of the base. A wall construction is provided having a lower edge configured to be received in the channel and an upper edge spaced vertically above the lower edge. A top enclosure is provided for being supported on the wall construction and has a downwardly opening groove configured to receive the upper edge of the wall construction so that the top enclosure is supported on the upper edge of the wall. A first drain means is included for draining liquid from the base and a second drain means is in fluid flow communication with the first drain means for draining the liquid from the channel into the first drain means, whereby liquid entering the channel flows through the second drain means and into the first drain means rather than accumulating in the channel and overflowing to the outside of the structure, and the wall construction is coupled between the base and the top enclosures and interacts with the base and top enclosures to withstand substantially horizontal loading from any substantially horizontal direction.

In accordance with yet another aspect of the present invention, the base includes a subbase having an upstanding outer rim extending generally around the periphery thereof and a sump. A linear is supported on the subbase and has an upstanding inner rim extending generally around the periphery thereof. The inner rim is spaced inwardly of the outer rim towards the center of the liner to form the channel between the inner and outer rims. The liner defines a support surface for supporting the subject located in the structure, the support surface being bounded by the inner rim. The first drain means is configured to drain liquid from the support surface into the sump of the subbase, and to expel liquid from the sump to the outside of the structure.

In accordance with yet an additional aspect of the invention, a plurality of first support ribs are integrally formed in the liner and extend in a side-by-side relationship generally across the support surface. A plurality of second support ribs are integrally formed in the subbase and extend in a side-by-side relationship generally across the subbase, and extend generally perpendicular to the first support ribs. The lower surface of the liner and the upper surface of the subbase are in contact when the liner is supported on the subbase, whereby the first support ribs and second support ribs interact to substantially eliminate significant vertical deflection of the support surface when the support surface is subjected to vertical loading due to the presence of the subject inside the structure. Preferably, the second drain means is formed by configuring the base so that the first ribs project upwardly from the support surface so as to define a plurality of first elongate recesses on a lower surface of the liner. The second ribs project downwardly from the subbase so as to define a plurality of second elongate recesses on an upper surface of the subbase. The first recesses are in fluid flow communication with the channel and the second recesses, and the second recesses are in fluid flow communication with the sump, whereby fluid in the channel flows into the first recesses, through the second recesses, and into a sump.

Other advantages and aspects of the present invention will be readily appreciated by those of ordinary skill in the art as the same becomes better understood by reference to the following detailed description of a preferred embodiment when considered in conjunction with the accompanied drawings in which.

Figure 1:
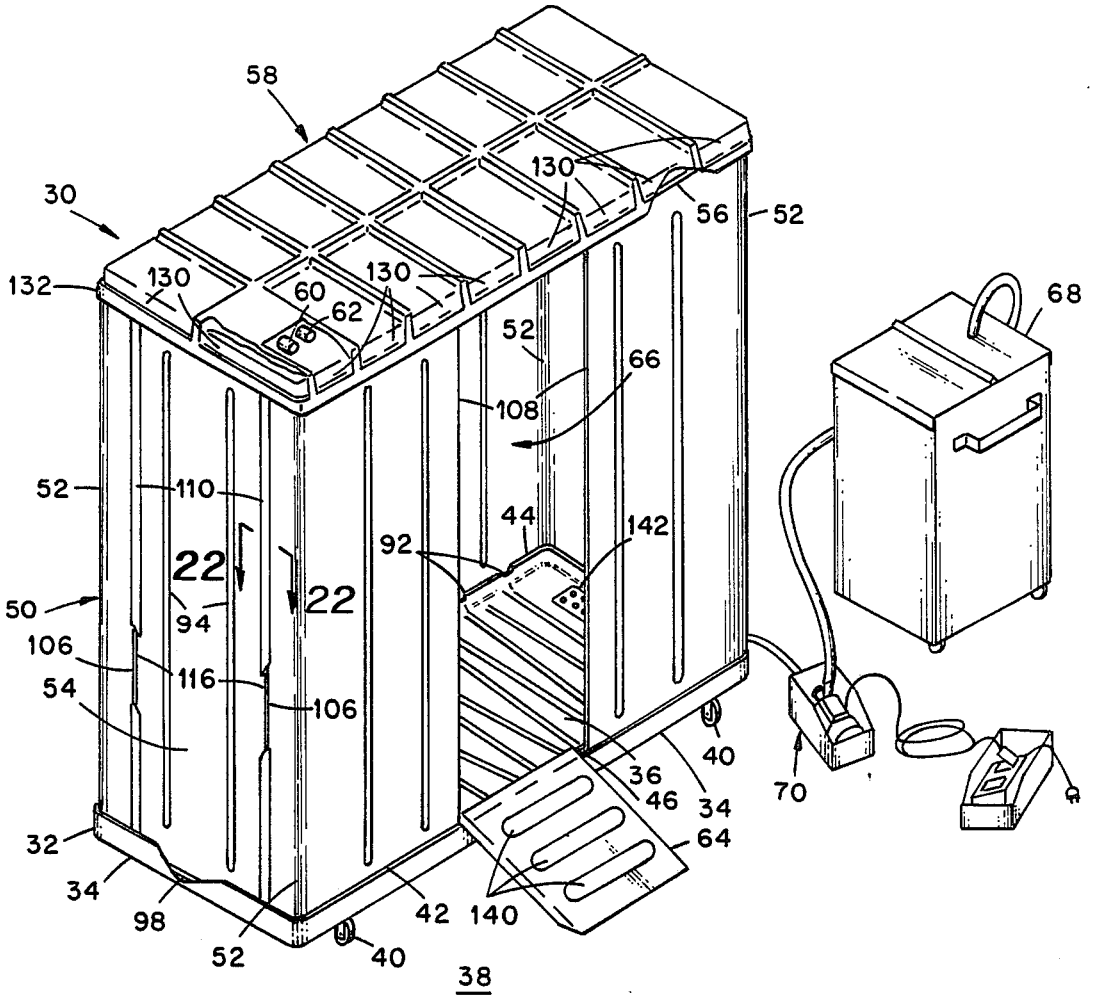
FIG. 1 is an elevational, perspective view of a decontamination chamber illustrating various features of a preferred form of the present invention.

Referring now to the drawings in which like reference characters refer to like or similar parts throughout the several views, there is shown in FIG. 1 a decontamination chamber 30 including various features of a preferred form of the present invention. A base 32 of the chamber 30 includes a generally rectangular subbase 34 and a liner 36 proportioned to fit in the subbase 34 and be supported thereon. The base 32 is elevated above a support surface 38, such as a floor, and is supported thereon by a plurality of rollers 40, of which two are visible in FIG. 1.

The subbase 34 and liner 36 are provided with upwardly extending rims 42 and 44, respectively, extending generally around the periphery thereof. The rim 44 on the liner 36 is proportioned complementary of the rim 42 on the subbase 34 so as to define a channel 46 therebetween. The channel has a width sufficient to receive a lower edge 48 of a substantially rectangular wall construction 50. The wall construction 50 includes corner panels 52 (FIG. 14), each of which has an arcuate panel section configured to correspond to arcuate channel sections of the channel 46 at the corners of the base 32. Between the corner panels 52, the wall construction 50 additionally includes generally planar panels 54. The corner panels 52 and planar panels 54 preferably have substantially identical vertical dimensions so that when both are placed in the channel 46 in the manner shown in FIG. 1, there is defined an upper edge 56 of the wall construction 50 substantially coplanar with the lower edge 48.

Figure 16:
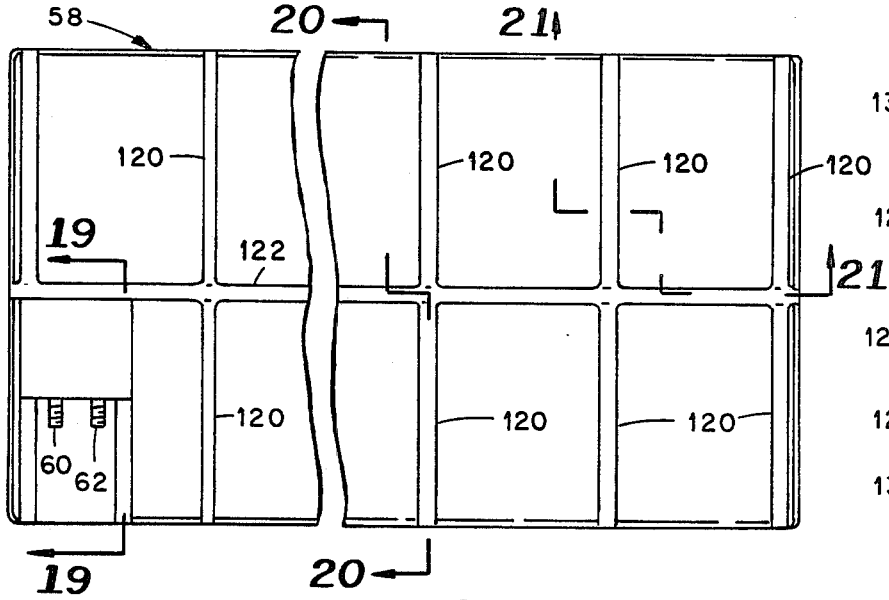
FIG. 16 is a plan view of a top forming an upper enclosure of the decontamination chamber shown in FIG. 1.
Figure 18:
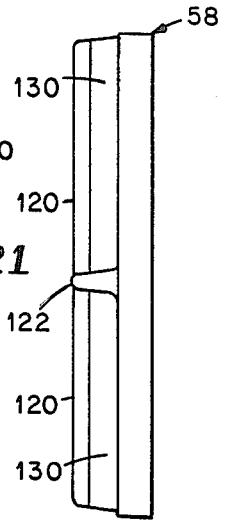
FIG. 18 is a side view of the top shown in FIG. 16.
Figure 17:
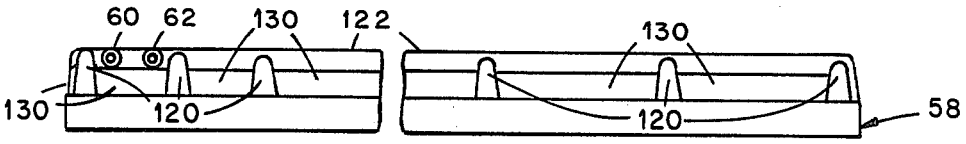
FIG. 17 is a front view of the top shown in FIG. 16.

A generally rectangular top 58 is supported on the wall construction 50 and includes a groove as will be described (see FIGS. 19 through 21) proportioned to correspond to the upper edge 56 of the wall construction 50 so that when the top 58 is placed on the wall construction 50, the edge 56 is received in the groove and the top 58 rests on the wall construction 50. A water distribution system (not shown) is incorporated into the top 58 and may include one or more shower heads or the like with water being supplied thereto through nipples 60 and 62 (see FIGS. 16 & 17) supplying hot and cold water, respectively.

A ramp 64 is provided for aiding in the entry of a subject into the chamber 30 through a door opening 66 defined between two opposed corner panels 52. The ramp 64 may include a front, down-turned edge member proportioned to correspond to the channel 46 and making an angle with the flat portion of the ramp 64 so that the down-turned portion may be inserted into the channel 46 while the opposite end of the ramp 64 is resting on the support surface 38.

As will be described, a drainage system of the chamber 30 is configured to deliver the washings from the chamber 30 in a manner which substantially prevents the washings from spilling over onto the support surface 38. Further provision is made to pass the washings onto a filtration device 68 such as through the use of a sump pump 70 having its inlet connected to a sump 72 formed in the subbase 34, and having its outlet connected to an inlet on the filtration device 68. Filters located in the sump and in the filtration device 68 remove any undesired contaminants from the washings, such as asbestos fibers, before the effluent is passed on to other treatment stages or released to a public drainage system.

A preferred form of the subbase 34 will now be described with reference to FIGS. 2 through 6. A sump 72 located at the right-hand end of the subbase 34 as viewed in FIGS. 2 and 3 facilitates elimination of liquid from the base. A plurality of upwardly opening, longitudinally extending ribs 74 are integrally formed in the subbase 34 and project from the lower surface thereof. Each rib 74 defines a channel 76 along the upper surface of the subbase 34, and each channel 76 opens into the sump 72 at one end. As will be described, the channels 76 receive and conduct liquid flowing into the subbase 34 from the channel 46 and provide longitudinal support for the subbase 34.

Figure 4:
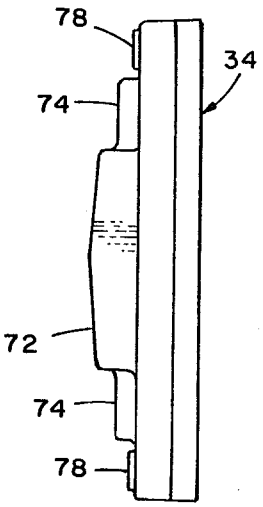
FIG. 4 is a side view of the subbase shown in FIG. 2.
Figure 2:
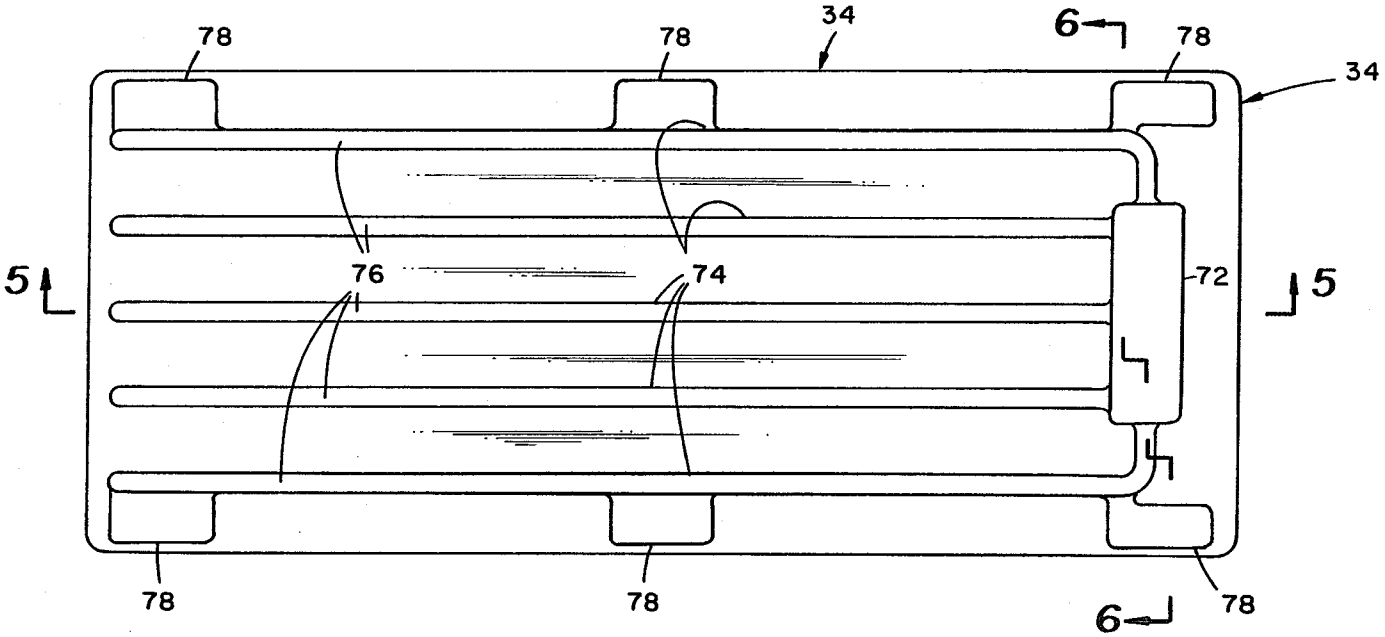
FIG. 2 is a view of the undersurface of a subbase of the decontamination chamber.
Figure 3:
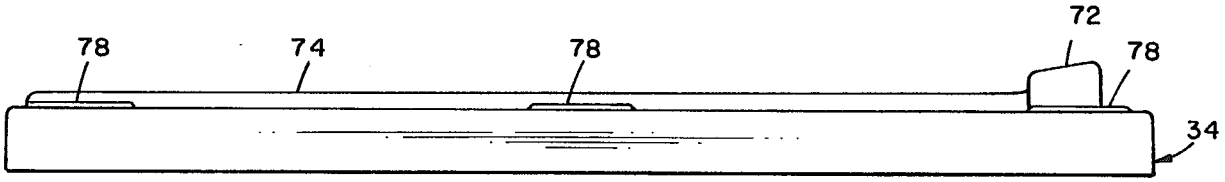
FIG. 3 is a front view of the subbase shown in FIG. 2.

A plurality of pockets 78 are formed in the subbase 34 and open into the outermost channels 76. The pockets 78 pass liquid accumulating along the outside portions of the subbase 34 into the channels 76 and provide a surface to which the rollers 40 may be attached. As can be seen in FIGS. 3 and 4, the pockets 78 are somewhat more shallow than the channels 76 which are in turn more shallow than the sump 72. This ensures rapid drainage of liquid entering the subbase 34 due to the cascading effect of the progressively deeper drainage media provided by the combination of the pockets 78, channels 76 and sump 72.

Figure 5:
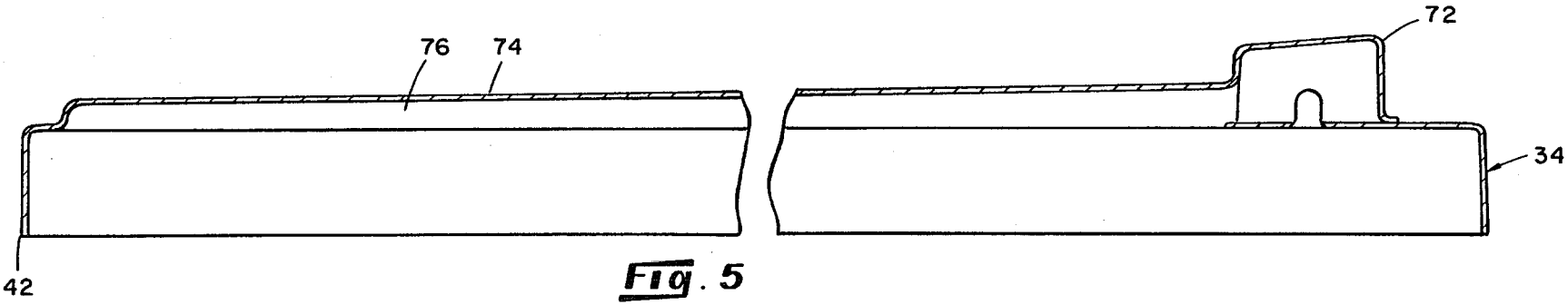
FIG. 5 is a view along line 5—5 of the subbase shown in FIG. 2.
Figure 6:
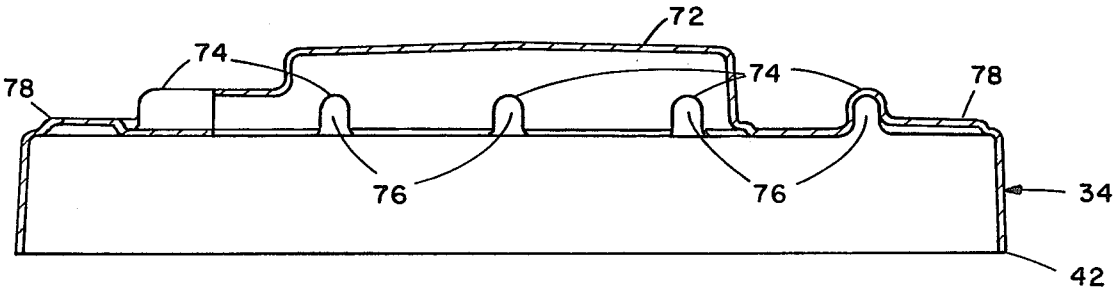
FIG. 6 is a view along line 6—6 of the subbase shown in FIG. 2.

As shown in FIG. 5, the ribs 74 are configured so that the channels 76 are deeper at their ends towards the sump 72; that is, the bottom of each rib 74 slopes downwardly from its end opposite the sump 72 to its end opening into the sump 72. This substantially prevents pooling of the liquid in the channels 76 since liquid flow towards the sump 72 is induced by the sloping arrangement of the ribs 74. The middle channels 76 open straight into the sump 72 and, as shown in FIG. 6, the width of the sump 72 is preferably sufficient to encompass the openings of at least the middle channels 76 to substantially eliminate any constraint on the flow of liquid from the channels 76 into the sump 72. The outer channels 76 open into the sides of the sump 72 through bends at their ends adjacent the sump 72.

Figure 7:
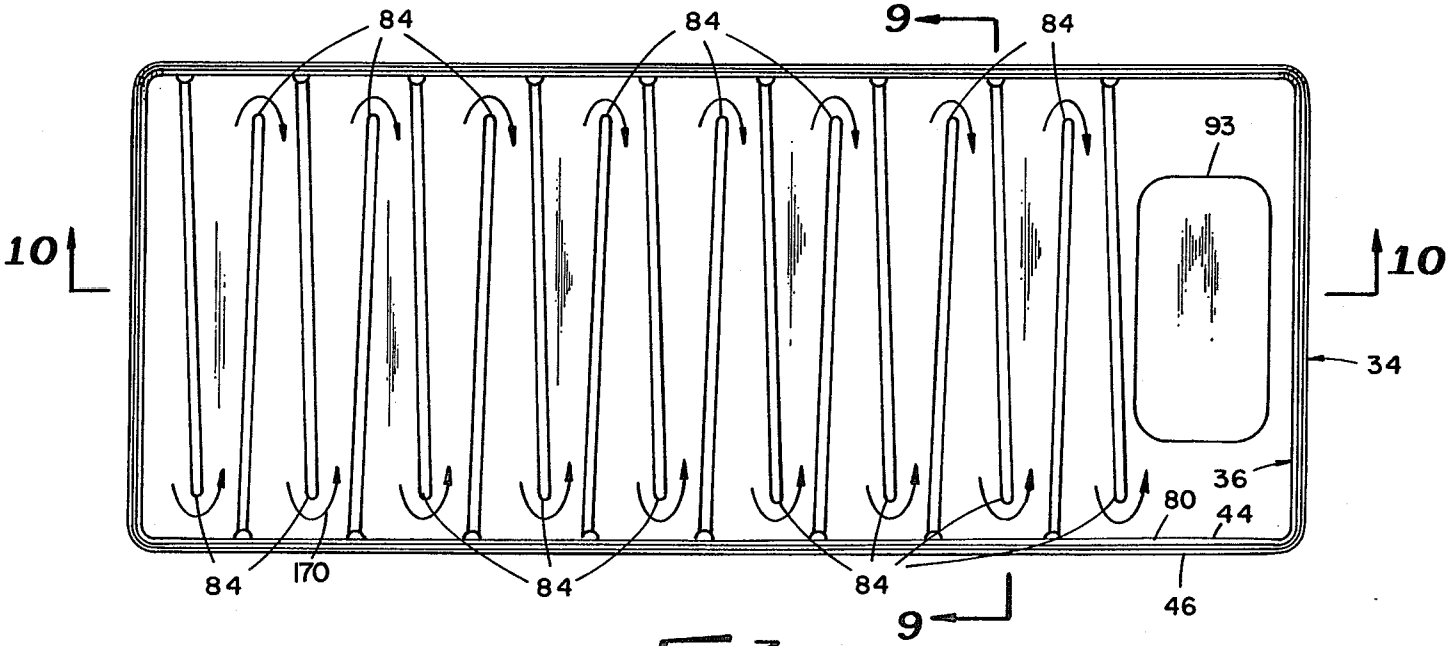
FIG. 7 is a top plan view of a liner for use with the subbase shown in FIG. 2.
Figure 8:
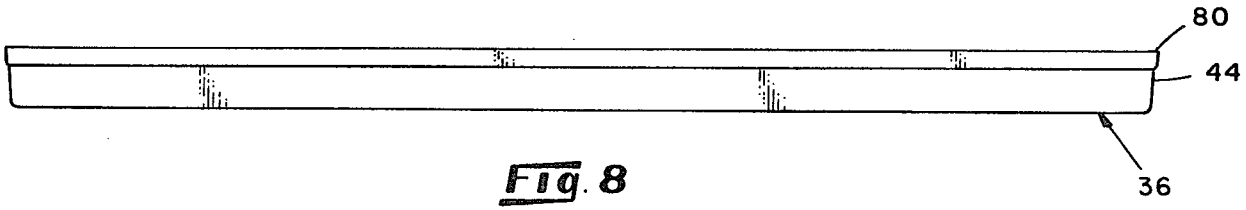
FIG. 8 is a front view of the liner shown in FIG. 7.

Referring now to FIG. 7, the liner 36 is shown having been positioned within the subbase 34. As was indicated above, a channel 46 exists between the rims 42 and 44 of the subbase 34 and liner 36, respectively, in the completed base 32, and is proportioned to accommodate the lower edge 48 of the wall construction 50. Thus, the rim 44 is spaced inwardly of the rim 42 by an amount approximately equal to the desired width of the channel 46. To accomplish this, means are provided for centering the liner 36 with respect to the subbase 34 during assembly of the base 32. Preferably, such means include providing a removable centering tab 80 or bead on the upper edge of the rim 44 of the liner 36 when the liner is manufactured. The tab 80 may be a continuous flared-out portion of the rim 44 encompassing a portion of the height of the rim 44 around its periphery. The tab 80 is proportioned so that its outer surface engages the inner surface of the rim 42 of the subbase 34 when the liner 36 is placed in the subbase 34. The resulting engagement is sufficient to guide the liner 36 down into the subbase 34 in a centered relationship therewith. However, the relevant proportions should not impede movement of the liner 36 down into the subbase 34 and should permit the lower surface of the liner 36 to be placed on the upper surface of the subbase 34.

Figure 9:
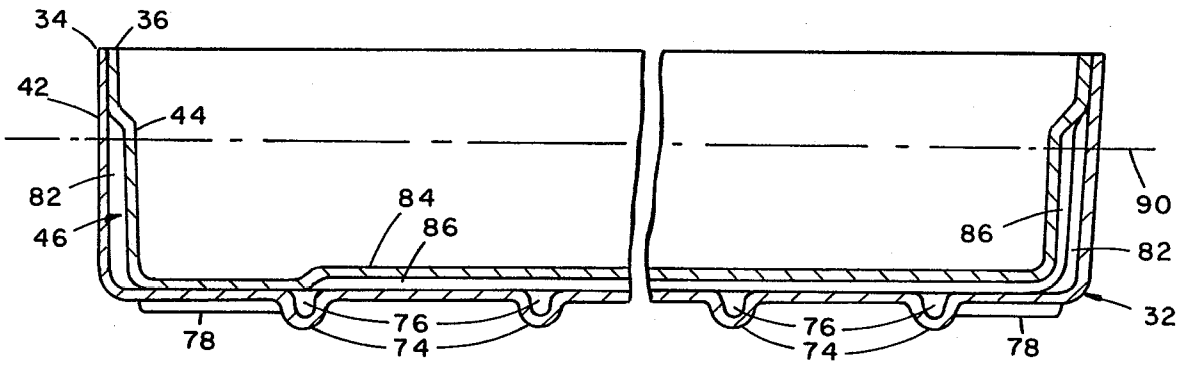
FIG. 9 is a view along line 9—9 of the liner shown in FIG. 7.
Figure 10:
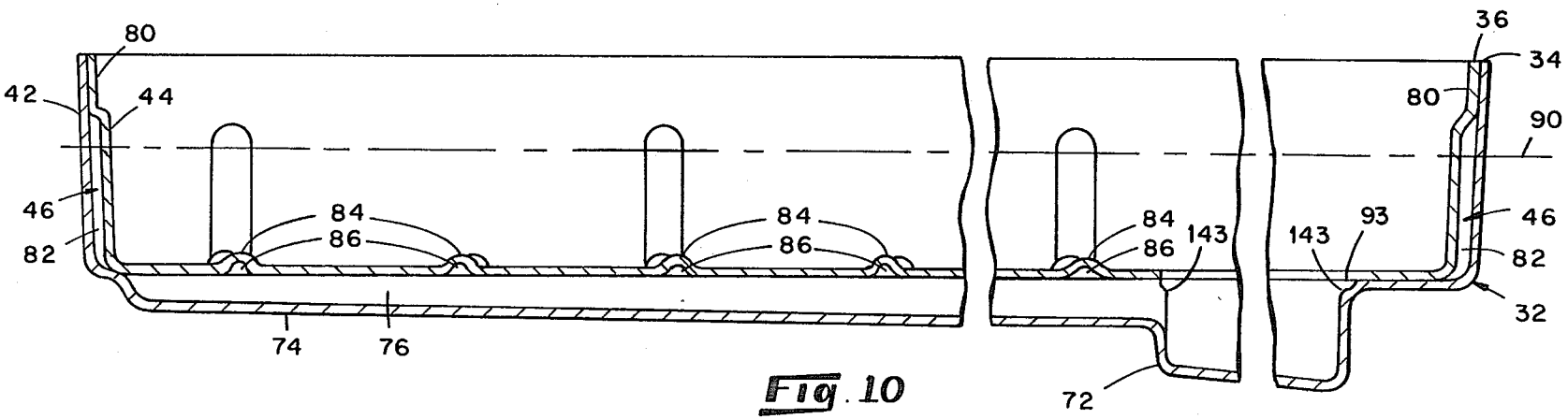
FIG. 10 is a view along line 10—10 of the liner shown in FIG. 7.
Figure 15:
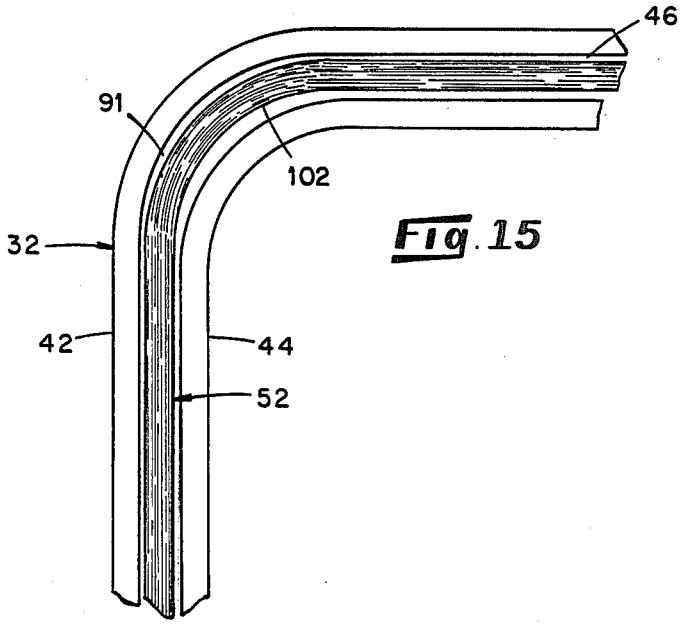
FIG. 15 is a fragmentary view in section of the wall construction illustrating the position of a portion of the corner panel in a channel formed between the liner and subbase.

Once the liner 36 has been placed and centered in the subbase 34 as described, and as illustrated in FIGS. 9 and 10, a space 82 having a width dimension corresponding to the desired width of the channel 46 exists between the rims 42 and 44. Before the liner 36 is placed in the subbase 34, a water-insoluble adhesive is applied to the upper surface of the subbase 34. Then, when the liner 36 is located in the subbase 34 as shown in FIGS. 9 and 10 the planar portions of the lower surface of the liner 36 and the planar portions of the upper surface of the subbase 34 are brought into contact with the adhesive therebetween, which is allowed to dry to form a bond between the liner 36 and subbase 34. After the liner 36 and subbase 34 have been secured together, a horizontal cut is effected in a plane through both the liner 36 and subbase 34 generally along the dashed line 90 indicated in FIGS. 9 and 10. This opens the space 82 from the top to form the channel 46 extending generally around the periphery of the base 32. Once formed, the channel 46 is seen to include arcuate channel sections 91 at the corners of the base 32 (see FIG. 15), which sections preferably are approximately ninety degree arcuate bends.

Considering FIG. 7 in conjunction with FIGS. 9 and 10, a plurality of support ribs 84 are shown extending generally laterally across the liner 36 and generally perpendicularly to the ribs 74 in the subbase 34. The support ribs 84 are integrally formed in the liner 36 and project from the upper surface of the liner 36. The ribs 84 also extend up a portion of the inside surface of the rim 44 and project inwardly therefrom. As can be seen in FIGS. 7 and 10, the ribs 84 preferably extend up the rim 44 in an alternating fashion; that is, any pair of adjacent ribs 84 do not both extend up the rim 44 on the same side of the liner 36. And, each rib 84 terminates a distance from the inside wall of the rim 44 opposite the side of the rim 44 from which the rib 84 projects.

The ribs 84 of the liner 36 define channels 86 generally along their lengths between the liner 36 and subbase 34. Comparing FIGS. 9 and 10, it is seen that the channels 86 communicate with the channels 76 defined by the ribs 74 of the subbase 34.

When the cut is made along line 90, the upper ends of the channels 86 extending up the rim 44 are positioned to define a plurality of drain openings 92. The drain openings 92 are spaced apart below the upper edge of the rim 44 of the liner 36, thereby providing for drainage of liquid moving down or splashing against the inner surface of the wall construction 50 into the channels 86, through the channels 76, and on to the sump 72. This arrangement also provides for drainage of liquid accumulating in the channel 46, in that the liquid there is free to pass into the channels 76 and on to the sump 72 via the channels 86 defined by the ribs 84. Thus, the channel 46 is not likely to become filled with water and any spillage of contaminated water therefrom to the outside of the chamber 30 is substantially eliminated.

It should be appreciated that the arrangement of the ribs 84 and 74 in the liner 36 and subbase 34, respectively, also aids in achieving a substantially rigid construction of the base 32 in terms of the ability of the base 32 to provide vertical support for a subject within the chamber 30. The interaction of the ribs 84 and 74 when the subbase 34 and liner 36 are secured together makes the base 32 substantially inflexible to vertical loading. A substantial factor in achieving this support is the lattice nature of the relationship between the ribs 74 and 84 due to their relative perpendicularity. Yet, the attributes of the lightweight construction of the base 32 are maintained as afforded by the configuration of the liner 36 and subbase 34. These improved structural attributes are achieved by the configuration of the ribs 74 and 84 while at the same time providing for drainage of liquid from the channel 46 and from the inside surfaces of the walls of the wall construction 50 to prevent contaminated liquid from spilling to the outside of the chamber 30.

Another aspect of the construction of the base 32 includes the manner in which the ribs 84 of the liner 36 are arranged. As shown in FIG. 7, the ribs 84 of the liner 36 are arranged in a staggered, alternately parallel fashion. This improves the drainage characteristics of the base 32 by controlling the rush of liquid towards a drain opening 92 of the liner 36 which communicates with the sump 72. This fluid control can be seen when the arrows 170 indicative of the fluid flow pattern are considered. As described, each rib 84 terminates a distance of the rim 44 and it is through this distance that the major portion of liquid moving past each rib 84 travels. In this regard, the height of the ribs 84 is selected to induce a pooling of the liquid to one side of the rib 84 on the side of the rib 84 opposite the side facing the drain opening 92. Also, each rib 84 makes a slight angle with the ribs adjacent thereto in the manner shown to further induce and create a path of liquid flow in the direction of the drain 92.

A preferred form of the wall construction 50 will now be described with reference to FIG. 1 in conjunction with FIGS. 11 through 14. As noted above, the wall construction 50 preferably includes four corner panels 52 between which are located one or more planar panels 54. Both the corner panels 52 and planar panels 54 include integrally formed, vertically extending reinforcing ribs 94 which project outwardly therefrom to provide support to the wall construction 50. The ribs 94 terminate at their upper and lower ends a sufficient distance from the upper and lower edges 56 and 48, respectively, so that they do not interfere with placement of the wall construction 50 in the base 32 or placement of the top 58 on the wall construction 50.

Figure 14:
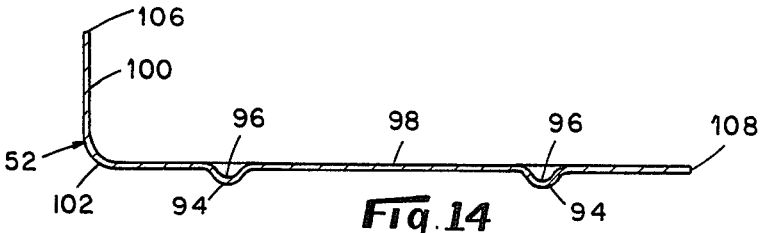
FIG. 14 is a top view of the corner panel shown in FIG. 11.
Figure 11:
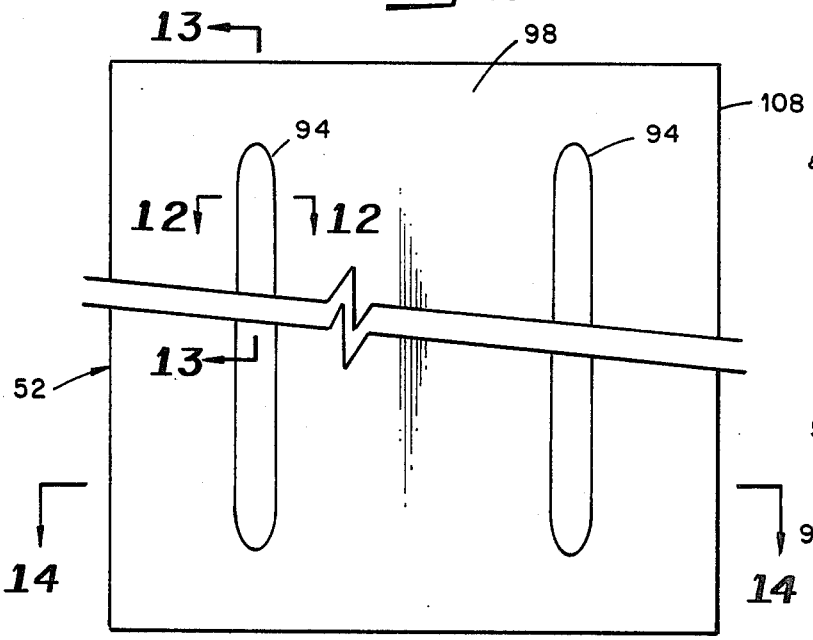
FIG. 11 is a front elevational view of a corner panel for use in a wall construction of the decontamination chamber shown in FIG. 1.
Figure 12:
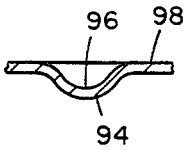
FIG. 12 is a view along line 12—12 of the corner panel shown in FIG. 11.
Figure 13:
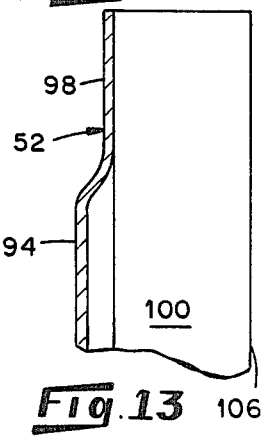
FIG. 13 is a view along line 13—13 of the corner panel shown in FIG. 11.

Each corner panel 52 includes a longer portion 98 across its width integral with a shorter portion 100 along its depth, both of which can be seen in FIG. 14. The portions 98 and 100 meet at an arcuate panel section 102 proporational to correspond to the arcuate channel sections 91 in the channel 46 at the corners of the base 32. This shape relationship between the arcuate panel section 102 of the corner panels 52 and the channel 46 defined between the rims 42 and 44 is illustrated in the cross-sectional view of FIG. 15. There, a portion of the corner panel 52 is illustrated residing in the channel 46 between the rims 42 and 44.

In the peferred form of the wall construction 50, the planar panels 54 are dimensioned in width to correspond substantially to the width of the longer ends 98 of the corner panels 52. This provides for storage of the planar panels 54 in a space approximately equal to the width of the corner panels 52. Also, the reinforcing ribs 94 on the planar panels 54 are spaced apart approximately the same distance as the reinforcing ribs 94 on the corner panels 52. This permits the planar panels 54 and corner panels 52 to be stacked in a nested relationship.

Preferably, the relative proportions of the base 32, corner panels 52 and planar panels 54 are selected to provide that the door opening 66 has a width substantially equal to the distance between vertical side edges 106 of opposite shorter portions 100 of the corner panels 52 when the corner panels 52 are positioned on the base 32 as shown in FIG. 1; that is, the door opening 66 should have substantially the same width as the width of the planar panels 54. In this preferred configuration, the door opening 66 could thereby be moved between a selected one or more locations such as at the end of the chamber 30 between the vertical side edges 106 of opposed shorter portions 100 of the corner panels 52. In that case, a planar panel 54 would be positioned in what is now shown as the door opening 66 in FIG. 1 and the location at which the planar panel 54 is now indicated would be a door opening permitting ingress and egress of the subject at the end of the chamber 30. The configuration also provides for the use of a single door opening 66 as shown in FIG. 1 at the front of the chamber 30 with a planar panel 54 (not shown) being located between vertical side edges 106 of opposed longer portions 98 of the corner panels 52 on the back of the chamber 30. Thus, the configuration of the corner panels 52 and planar panels 54 provides great flexibility on locating the door opening 66 to achieve the desired manner of entry and exit of the chamber 30.

Figure 22:
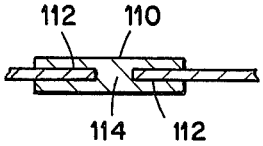
FIG. 22 is a view along line 22—22 of the decontamination chamber shown in FIG. 1 illustrating an H-shaped connector for joining the corner panels to adjacent planar panels.

The corner panels 52 and planar panels 54 may be joined together by connectors 110 which, as illustrated in FIG. 22, are H-shaped in cross section and have oppositely facing channels 112 proportioned to receive the vertical side edges of the planar and corner panels 54 and 52. Preferably, the channels 112 are slightly narrower than the thickness of the panels. Also, the connectors 110 are constructed of a material which permits resilient widening of the channels 112 to sealingly receive the vertical side edges of the panels with a snug fit. This prevents significant untoward relative movement of the panels and substantially eliminates any passage of fluid from inside the chamber 30 to the outside at the location where the panels are joined together. A bridge portion 114 of the connectors 110 is proportioned to correspond to the distance of separation between the side edges 106 and 108 of the corner panels 52 and edges 116 of the planar panels 54. Further, the overall thickness of the connectors 110 is greater than the width of the channels 46 so that the connectors 110 can extend down and abut into the channels with the planar and corner panels 54 and 52 and prevent splashing of liquid out of the chamber 30 between adjacent vertical edges of the planar and corner panels 54 and 52.

Features of the top 58 will now be described with reference to FIG. 1 in conjunction with FIGURES 16 through 21. From the illustrations it is seen that the top 58 includes a grid of integrally formed support ribs including spaced-apart laterally extending ribs 120 interconnected by a centrally located, longitudinally extending rib 122 with both the lateral and longitudinal ribs 120 and 122 projecting upwardly from the upper surface of the top 58. The ribs 120 and 122 provide a rigid vertical support for connection to the top 58 of showering implements such as pipes, shower heads and the like. The ribs 120 and 122 also provide recessed portions in the undersurface of the top 58 for location of a suitable piping network for providing liquid decontaminant distribution in the chamber 30 in a desired pattern. One such pipe 123 is illustrated in FIG. 20 located in the recess provided by the longitudinally extending rib 122. Suitable means are employed such as hot and cold valves (not shown) for mixing the hot and cold water received within the top 58 through the hot and cold nipples 60 and 62 prior to distribution of the water through the piping in the top 58. Or, an automatic tempering valve may be employed behind the nipples 60 and 62 to supply water to the inside of the chamber 30 at a substantially constant temperature. An auxiliary hose (not shown) may also be provided for washing tools, etc.

Figure 19:
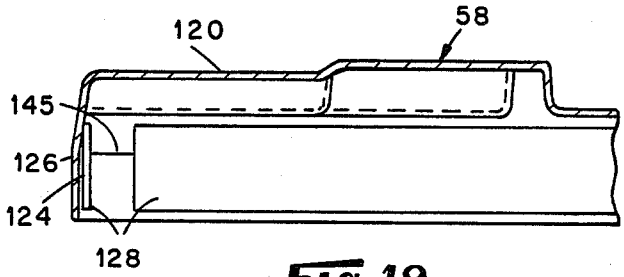
FIG. 19 is a view along line 19—19 of the top shown in FIG. 16.
Figure 20:
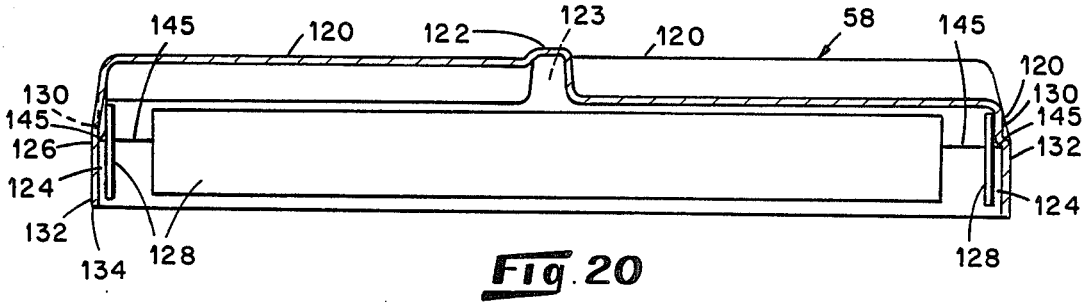
FIG. 20 is a view along line 20—20 of the top shown in FIG. 16.
Figure 21:
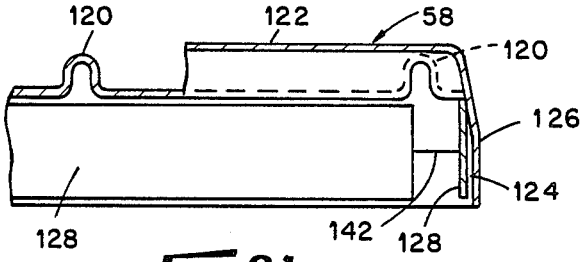
FIG. 21 is a view along line 21—21 of the top shown in FIG. 16.

As can be seen in FIGS. 19 through 21, a groove 124 is defined between an outer side wall 126 of the top 58 and a series of substantially vertical plates 128 fastened at their tops to the inside surface of the side wall 126. The plates 128, preferably four in number, are fastened such as by the use of an adhesive or screws (not shown) to substantially planar, vertical indents 130 of the side wall 126 which are defined between adjacent lateral ribs 120, and at opposite longitudinal ends of the top 58 on either side of the longitudinal rib 122. These indents 130 can best be seen in FIG. 1 where it is noticed that each rib 120 extends down along the side wall 126 to a skirt portion 132 of the side wall 126. The skirt portion 132 extends substantially vertically downwardly from the outwardly sloping ends of the ribs 120 and 122 and is therefore spaced outwardly from the indents 130. This configuration provides that when the plates 128 are fastened onto the indents 130, there will exist a space between the plates 128 and the skirt 132 having the desired proportions for receiving the upper edge 56 of the wall construction 50.

Preferably, and for simplicity, four plates 128 are used and are vertically dimensioned to extend down to near a lower edge 134 of the skirt 132 and are horizontally dimensioned so that they do not meet at the corners on the inside of the top 58, to allow for the roundness of the corners. This provides, for example, the capability of using substantially planar metal or plastic sections and forming the plates 128 without the necessity of incorporating ends conforming to the shape of the top 58.

The overall proportions of the top 58 are selected to provide that upon the incorporation of the plates 128 therein to form the groove 124, the same has a shape, when viewed from the undersurface of the top 58, corresponding substantially to the upper edge 56 of the wall construction 50 so that the edge 56 will be fittingly received within the groove 124 when the top 58 is placed on the wall construction 50.

In manufacturing the various components of the chamber 30, the corner and planar panels 52 and 54, the top 58, and the subbase 34 and liner 36 are preferably produced in a vacuum forming process using a thermoplastic polymer blend to achieve the desired configurations. A suitable lightweight plastic for this purpose is an acrylonitrile-butadiene-styrene copolymer, commonly referred to as ABS resin, which can be produced to have suitable properties for use in the environment of the chamber 30. The ramp 64 may be constructed from a suitable aluminum alloy and may include lateral reinforcing ribs 140. As noted, the subbase 34 and liner 36 are bonded together and cut along line 90, and this preferably occurs prior to packaging the components of the chamber 30.

A drain cover 142 having a plurality of flow-through apertures is provided for being positioned over the opening 93 in the liner 36. The opening 93 is configured to have a shoulder 143 which may be formed in the subbase 34 around the sump 72. The shoulder 143 is proportioned to receive and support the drain cover 142 so that the cover 142 is substantially flush with the upper surface of the liner 36. The cover 142 is preferably formed from a suitable aluminum alloy plate.

A large particle filter or screen (not shown) may be provided and located beneath the drain cover 142 to capture any large particles before they enter the sump 72. However, the filter should not introduce a significant obstruction of liquid out of the liner 36 into the sump 72. If desired, the drain cover 142 and filter may be incorporated into the base 32 prior to packaging the base 32 but are preferably kept separate so that the filter may be easily removed and cleaned periodically during use of the chamber 30.

The rollers 40 may be of the locking type to prevent undesired movement of the chamber 30 during use.

The connectors 110 may be formed of a lightweight metal such as aluminum through an extrusion process. Preferably, a connector 110 is riveted to each vertical side edge 106 of the corner panels 52 prior to packaging the components of the chamber 30. This makes assembly of the wall construction 50 easier since it is only necessary to insert the side edges 116 of the planar panels 54 in the connectors 110 when the wall construction 50 is assembled. Alternately, the connectors 110 can be pre-fastened to the planar panels 54 during construction of the chamber 30.

The water distribution system included in the top 58 may utilize plastic tubing and components where appropriate, as well as brass or chrome-plated steel fittings and components in the usual manner.

In assembling the chamber 30, the base 32 is first placed in its desired location on the support surface 38. The rollers 40 may be locked at this time to prevent movement during assembly and afterwards. A pair of corner panels 52 are then positioned adjacent each other in an opposed relationship approximating the configuration of one longitudinal end of the chamber 30. Then, a planar panel 54 is positioned between the corner panels 52 and its vertical side edges 116 snapped into the channels 112 of the connectors 110 which have been previously riveted to the corner panels 52. A length of adhesive tape is then wrapped around the three pieces so as to hold them together temporarily prior to placement of the top 58 thereon. The corner panels 52 and planar panel 54 may then be placed on the base 32 in the channel 46. The light weight of the corner panels 52 and planar panel 54 permit this to be done easily by one person standing at the end of the base 32. The same procedure is repeated for two other corner panels 52 and a planar panel 54 at the other end of the base 32. Then, a planar panel 54 may be positioned intermediate vertical side edges 108 of the corner panels on the back side of the base 32 with connectors 110 positioned between the vertical side edges 116 of the planar panel 54 and the vertical side edges 108 of the corner panels so as to connect them together, providing for enclosure of the back side of the chamber 30. It should be noted that in the preferred form of the chamber 30, the rims 42 and 44 of the base 32 are configured to slant outwardly by a small amount as shown in FIGS. 9 and 10. This provides for a snug fit of the lower edge 48 of the wall construction 50 in the channel 46 since the corner and planar panels 52 and 54 will bind slightly in the channel 46. Initially, during assembly, this binding may tend to induce an outward disposition of the corner and planar panels 52 and 54 which can be temporarily controlled through the use of adhesive tape as described above.

Figure 23:
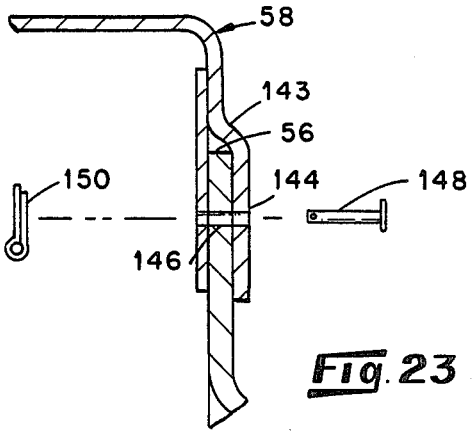
FIG. 23 is a cross-sectional view of one of a plurality of locations at which the top may be secured to the wall construction using clevis pins and cotter keys.

The top 58 is then placed on the upper edge 56 by guiding the latter into the groove 124 of the top 58 generally between the plates 128 and skirt 132. As can be seen in FIG. 23, the top 58 will come to rest on the upper edge 56 with an inwardly directed shoulder 145 at the base of the indents 130 of the top 58 resting on the edge 56. In this manner, the upper edge 56 will not tend to cause separation of the plates 128 from their attachments to the indents 130.

To prevent upward displacement of the top 58, holes 144 (see FIG. 23) are spaced along the front and back sides of the top 58 and extend through the skirt 132 and plates 128. A plurality of holes 146 are made along the upper edge of the longer portion 98 of each corner panel 52 and spaced and dimensioned complementary of the holes 144 so that when the top 58 is placed on the wall construction 50, the holes 144 and 146 will be aligned for receiving therethrough clevis pins 148 which may be secured in the holes 144 and 146 through the use of cotter pins 150.

A plastic shower curtain 152 is then connected generally along its upper edge to the top 58. The curtain 152 is preferably formed of a relatively heavy plastic film and has a width sufficient to encompass the width of the door opening 66, and extend along the inner face of the adjacent corner panels 52 an amount which substantially eliminates the splashing of liquid out of the door openings 66 along the vertical side edges 108 of the corner panels 52. Additionally, the height of the curtain or the extension of the curtain down beyond the rim 44 of the liner 36 should be sufficient to substantially eliminate splashing of liquid out of the door opening 66 along the bottom edge of the opening 66.

Figure 24:
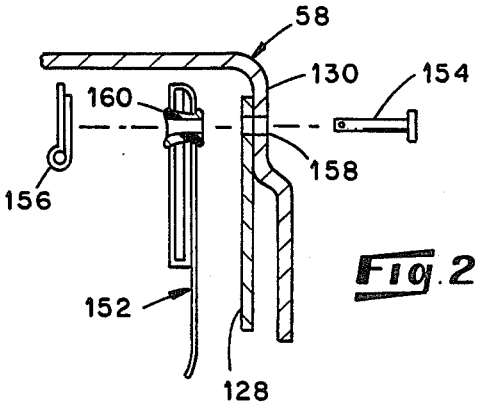
FIG. 24 is a cross-sectional view of one of a plurality of locations at which a shower curtain may be secured to the top using clevis pins and cotter keys.

A preferred means for attaching the curtain 152 to the top 58 is illustrated in FIG. 24. The curtain 152 is provided with eyelets 160 along its upper end with the eyelets 160 (only one attachment location is illustrated in FIG. 24 for clarity) spaced to correspond to openings 158 formed in the indents 130 of the top 58. The openings 158 pass through both the indents 130 and the plates 128 and are proportioned to receive clevis pins 154 on which the eyelets 160 of the curtain 152 are placed, and secured thereto by the use of cotter pins 156.

Preferably, the spacing of the eyelets 160 is such that when the curtain 152 is attached to the top 58 the curtain 152 is maintained in a substantially planar configuration adjacent the door opening 66 on the inside of the wall construction 50. It is seen that with the curtain 152 attached along the indents 130 the likelihood of water finding its way over the top of the curtain 152 is minimized. Nevertheless, should any water pass over the top of the curtain 152 it would be directed down the inside surface of the plates 128 or, at the corners of the top 58, down the inner surface of the top 58. In either case, the liquid would drain down the inner surface of the wall construction 50 rather than be admited to the outside of the chamber 30. Also, the curtain 152, during use, will tend to matte against the adjacent surface of the wall construction 50 and parts of the liner 36 which will further tend to inhibit escape of any liquid washings out of the chamber 30.

The preferred embodiment of the decontamination chamber 30 described is capable of being set up in less than thirty minutes and requires no more than two persons for the assembly. The only extra materials that may be required are some adhesive tape and a few simple tools such as screwdrivers and adjustable wrenches. And, the chamber 30 is constructed of very lightweight material so that when the various parts are disassembled they can easily be carried from one site to another in a suitable container. In this regard, it is noted that the chamber 30 can be disassembled as quickly as it is assembled allowing rapid relocation of the chamber to new sites.

Other advantages offered by the invention, as discussed above, relate to the construction of the base 32 and the manner in which drainage of liquid washings is achieved while substantially eliminating the possibility of overflow from the channel 46. Furthermore, the integral longer and shorter portions 98 and 100 of the corner panels 52 provide a sturdy configuration for the wall construction 50 when the upper and lower edges 56 and 48 of the wall construction 50 are confined in the groove 124 of the top 58 and the channel 46 of the base 32. The structure is substantially incapable of being shifted or twisted horizontally due to a large extent to the construction of the arcuate panel sections 102 of the corner panels 52 and the confinement of the arcuate panel sections 102 in the bends of the channel 46 and groove 124. In effect, the channel 46 and groove 124 in the base 32 and top 58 form a coupling system for detachably coupling the corner panels 52 between the base 32 and top 58. In the resulting structure, the corner panels 52 interact with the top 58 and base 32 to resist horizontal loading from any horizontal location.

Although a particular embodiment of the decontamination chamber 30 has been described above, it will be understood that the invention is capable of numerous rearrangements, modifications and substitutions without departing from the scope of the invention as set forth in the claims below.

What is claimed:

1. A portable, knockdown structure for use with a liquid decontamination applied to a subject located inside the structure, comprising:

a support surface for supporting the subject located inside the structure;

a plurality of rounded corners formed on said support surface;

upwardly opening arcuate channel sections formed along the rounded corners of said support surface;

upwardly opening linear channel sections formed on said support surface extending between said arcuate channel sections, said arcuate and linear channel sections together forming a continuous channel around the periphery of said support surface;

corner panels, each having an arcuate panel section with an upper edge, and at least one side panel section with an upper edge and being integrally formed with said arcuate panel section, said arcuate and side panel sections having lower edges configured to fit into said arcuate and linear channel sections, respectively, said arcuate and linear channel sections being defined between substantially continuous inner and outer upstanding rims extending around the periphery of said support surface, said inner and outer rims being spaced apart a distance of about, but greater than, the thickness of said arcuate and side panel sections and configured so that liquid decontaminant entering said channel is confined between said inner and outer rims, said inner and outer rims being angularly disposed with respect to said arcuate and side panel sections to impose a deflection force on said arcuate and side panel sections adjacent said lower edges to frictionally engage said lower edges of said arcuate and side panel sections in said channel when said corner panels are placed in said channel and resist dislodgment of said arcuate and side panel sections from said support surface;

a top enclosure for placement on said upper edges of said arcuate and side panel sections to prevent the upward escape of contaminant from the structure and to protect the subject from the elements;

arcuate groove means formed on said top enclosure for engagingly receiving the upper edges of said arcuate panel sections;

linear groove means formed on said top enclosure for engagingly receiving the upper edges of said side panel sections; and said arcuate and linear groove means and said arcuate and linear channel sections together forming a coupling system for detachably coupling said corner panels between said support surface and said top enclosure, whereby said corner panels interact with said top enclosure and said support surface to withstand substantially horizontal loading from any substantially horizontal direction.

2. The structure of claim 1, wherein said inner and outer rims include opposed, substantially paralle, channel wall surfaces and are configured with said channel wall surfaces slanting away from the center of said support surface so that when said corner panels are oriented substantially perpendicular to said support surface with said lower edges of said arcuate and side panel sections located in said arcuate and linear channel sections, said channel wall surfaces of said inner and outer rims frictionally engage said lower edges to hold said corner panels in said channel.

3. The structure of claim 1, further comprising planar panels having lower edges configured to fit within said linear channel sections and having upper edges lying in substantially the same plane as said upper edges of said arcuate and side panel sections of said corner panels when said lower edges of said planar panels are positioned in said linear channel sections, said linear groove means being configured to receive said upper edges so that said planar panels are detachably coupled between said support surface and said top enclosure.

4. The structure of claim 1, further comprising planar panels having lower edges configured to fit within said linear channel sections and having upper edges lying in substantially the same plane as said upper edges of said arcuate and side panel sections of said corner panels when said lower edges of said planar panels are positioned in said linear channel sections, said linear groove means being configured to receive said upper edges of said planar panels so that said planar panels are detachably coupled between said support surface and said top enclosure.

5. The structure of claim 4, further comprising:

said planar and corner panels having side edges; and means for sealably and detachably attaching together said side edges of said corner panels and said side edges of said planar panels so that when said planar and corner panels are detachably coupled between said support surface and said top enclosure, employing said means for attaching sealably and detachably attaches said corner and planar panels together and substantially prevents liquid contaminant from passing out of the structure between said side edges of said planar and corner panels.

6. The structure of claim 5, wherein said means for attaching comprises an elongate groove disposed along at least one of said side edges of at least said corner panels and configured to engagingly and sealably receive the side edge of an adjacent planar or corner panel.

7. A portable, knockdown structure for use with a liquid decontaminant applied to a subject located inside the structure, comprising:

a base having a support surface for supporting the subject inside the structure;

an upwardly opening channel extending generally around the periphery of said base;

a wall construction supported on said base and having a lower edge and an upper edge spaced vertically above said lower edge, said channel of said base being angularly disposed with respect to said wall construction to impose a deflection force on said wall construction adjacent said lower edge to frictionally engage said lower edge in said channel and resist displacement of said wall construction from said base, a top enclosure for being supported on said wall construction and having downwardly opening groove means configured to engagingly receive said upper edge of said wall construction so that said top enclosure is supported on said upper edge of said wall construction;

first drain means for draining liquid from said base; and second drain means in fluid flow communication with said first drain means for draining liquid from said channel into said first drain means, said second drain means being configured so that liquid entering said channel flows directly into said first drain means without entering said base and without accumulating in said channel and overflowing to the outside of the structure.

8. The structure of claim 7, wherein said channel and groove means include arcuate corner sections and said wall construction includes arcuate corner panels having lower and upper edges proportioned to fit in said arcuate corner sections of said channel and said groove means, respectively.

9. The structure of claim 7, wherein said base comprises:

a subbase having an upstanding outer rim extending continuously around the periphery thereof, and having a sump for accumulating liquid;

a liner supported on said subbase and having an upstanding inner rim extending continuously around the periphery thereof, said inner rim being spaced inwardly of said outer rim towards the center of said liner to form said channel between said inner and outer rims, said support surface being substantially planar and being bounded by said inner rim;

said first drain means being configured to rapidly drain liquid from said liner into said sump of said subbase, and to rapidly eliminate liquid from said sump to the outside of the structure; and said second drain means comprising a plurality of fluid flow passageways in fluid flow communication with said channel and said first drain means and configured to drain liquid directly and rapidly from said channel into said sump.

10. The structure of claim 9, wherein said subbase has an upper, generally planar surface, and said liner has a lower, generally planar surface supported on said said upper surface of said subbase and said passageways are formed between said upper and lower surface.

11. A portable, knockdown structure for use with a liquid decontaminant applied to a subject located inside the structure comprising:

a subbase;

a plurality of first support ribs extending in a side-by-side relationship across said subbase;

a liner supported on said subbase;

a plurality of second support ribs extending in a side-by-side relationship across said liner in a direction generally perpendicular to said first support ribs;

a support surface formed on said liner and being supported by said first support ribs;

a lower surface formed on said liner and being supported by said second support ribs and said support surface whereby said first and second support ribs interact to substantially eliminate vertical deflection of said liner;

a wall structure extending upwardly from the periphery of said subbase; and a top supported on said wall structure so that said subbase, liner, wall structure and top form a closed chamber.

12. The structure of claim 11, wherein said first support ribs are integrally formed in said subbase and said second support ribs are integrally formed in said liner.

13. The structure of claim 11, wherein said first ribs project downwardly from said subbase to define a plurality of elongate recesses on the upper surface of said subbase and said second ribs project upwardly from said liner to define a plurality of elongate recesses on the lower surface of said liner.

14. The structure of claim 11 or 13, wherein said liner includes a drain opening and is configured so that liquid flows along said support surface into said drain opening and said second support ribs are configured with terminating ends spaced from said wall structure and being arranged with adjacent ribs having their terminating ends on opposite sides of said wall surface so that liquid flowing on said support surface toward said drain opening is conducted substantially around said terminating ends.

15. The structure of claim 14, wherein said first ribs are arranged on said liner in a staggered, alternately parallel relationship so that fluid is conducted along said support surface substantially around said terminating ends of said ribs toward said drain opening in a flow path having an S-configuration to control the rate of flow into the drain opening.

* * * * *